United States Patent [19]

Shimada

[11] Patent Number: 4,720,203

[45] Date of Patent: Jan. 19, 1988

[54] PUSH-BUTTON TYPE MECHANICAL PENCIL

[75] Inventor: Shoji Shimada, Tokyo, Japan

[73] Assignee: Iwasaki Kinzoku Kogyo Co., Ltd., Japan

[21] Appl. No.: 860,132

[22] Filed: May 6, 1986

[30] Foreign Application Priority Data

May 16, 1985 [JP] Japan ..... 60-104871

[51] Int. Cl.[4] ..... B43K 21/22

[52] U.S. Cl. ..... 401/94; 401/65; 401/67

[58] Field of Search ..... 401/65, 67, 94

[56] References Cited

U.S. PATENT DOCUMENTS

| | | | |
|---|---|---|---|
| 4,218,153 | 8/1980 | Hashimoto | 401/67 |
| 4,269,524 | 5/1981 | Hashimoto et al. | 401/65 |
| 4,544,295 | 10/1985 | Hashimoto et al. | 401/67 |

FOREIGN PATENT DOCUMENTS

| | | | |
|---|---|---|---|
| 3118119 | 3/1982 | Fed. Rep. of Germany | 401/65 |
| 1045688 | 11/1953 | France | 401/67 |

*Primary Examiner*—Randolph A. Reese
*Assistant Examiner*—Anthony Knight
*Attorney, Agent, or Firm*—Lucas & Just

[57] ABSTRACT

A push-button type mechanical pencil consisting of a barrel which is composed of a clip-carrying upper barrel member and a metal tip-carrying lower barrel member, which barrel members are engaged with each other at a substantially intermediate portion of the barrel and joined to each other by a rotary unit structure so that the barrel members can be turned with respect to each other, a movable cylinder provided in the unit structure and adapted to be moved forward and backward in the axial direction owing to a screw pair, and a lead-extruding structure provided in the barrel and capable of projecting a lead in a stepped member by a very small length at a time by pressing the upper end of a push-down tube, which lead-extruding structure includes a push-button member projecting from the rear end of the barrel, a protective pipe provided in a bore at the free end of a metal tip provided at the lower portion of the lead-extending structure, and an outer tube fixed to the movable cylinder in the unit structure to operatively connect them to each other, the protective pipe in the lead-extruding structure being projected by an arbitrary length from the free end of the metal tip by turning either of the two barrel members.

1 Claim, 4 Drawing Figures

PUSH-BUTTON TYPE MECHANICAL PENCIL

BACKGROUND OF THE INVENTION

This invention relates to a push-button type mechanical pencil, wherein an upper barrel member or a lower barrel member, both of which form a barrel, is turned to move a lead-extruding structure, which is held in the interior of the barrel, forward and backward in the axial direction, and thereby enable the length of the portion of a lead-protecting pipe which projects out of the front end of a metal tip to be finely regulated in accordance with the purpose of using the mechanical pencil.

A mechanical pencil is provided with a lead-protecting pipe in a metal tip for the purpose of preventing the portion of the lead which projects from the free end of the metal tip from being broken. It is known that there are two types of structures for attaching a lead-protecting pipe to a metal tip. In one of these structures, a lead-protecting pipe is completely fixed to a metal tip. In the other structure, a lead-protecting pipe is attached to a metal tip so that the lead-protecting pipe retracts into the metal tip as the lead is worn while the mechanical pencil is in use. When a mechanical pencil employing the former type of lead-protecting pipe is used for the drawing purpose, especially, for drawing a line by utilizing a rule, the thickness of the rule and the length of a projecting portion of the lead-protecting pipe do not agree with each other, and it is difficult to draw a stable line.

When a mechanical pencil employing the latter type of lead-protecting pipe is used, the lead-protecting pipe moves freely in the backward direction while letters are written therewith, so that the mechanical pencil cannot be kept stable while in use. Therefore, a mechanical pencil employing this type of lead-protecting pipe is not suitable to be used for drawing which demands a high accuracy, whatever may be the case where it is used for general writing purposes. The lead-protecting pipe projects to a maximal extent whenever it is moved forward. Hence, especially, a lead-protecting pipe completely fixed to a metal tip is apt to damage the interior of a pocket or cause an accident. A lead-protecting pipe does not always require to be projected to a maximal extent when the mechanical pencil is used for writing ordinary letters, and the users have different favorite projection lengths of the lead-protecting pipe. Therefore, it is desirable that the projection length of a lead-protecting pipe be set optimumly in accordance with the use of the mechanical pencil and the taste of the users. However, as referred to above, the lead-protecting pipe in a conventional mechanical pencil is always projected to a maximal extent when the pencil is used. Consequently, it often occurs that a mechanical pencil cannot be used suitably for a certain purpose or in a desired manner due to the lead-protecting pipe of an unnecessarily large projection length.

SUMMARY OF THE INVENTION

An object of the present invention is to provide a push-button type mechanical pencil having a lead-protecting pipe, the projection length of which can be set to an optimum level within a permissible range and adjusted finely in accordance with various cases where the mechanical pencil is used for merely making a note, or drawing a line during the preparation of a design drawing, or in accordance with the taste of the users.

To achieve this object, the present invention provides a mechanical pencil consisting of a barrel composed of upper and lower barrel members, a connecting cylinder inserted in these barrel members and adapted to be turned with these barrel members when either of the barrel members is turned, a movable cylinder, which is a constituent part of the movable cylinder and formed so that it can be moved forward and backward, a lead-extruding structure inserted in the central bore in the movable cylinder, and a fixing cylinder by which the movable cylinder and lead-extruding structure are joined to each other; and adapted to be operated so that, when the movable cylinder is moved forward, the lead-extruding structure and a lead-protecting pipe are moved forward such a distance that corresponds to the distance the movable cylinder was moved, a required length of projection of the lead-protecting pipe from the free end of a metal tip attached to the lower barrel member being determined, the rear end of the lead-extruding structure being knocked when the lead-protecting pipe is projected, to project the lead.

A push button type mechanical pencil of the present invention comprises a barrel consisting of upper and lower barrel members which are engaged with each other at a substantially vertically-intermediate portion of said barrel; a unit structure of a rotatable construction which combines said upper and lower barrel members with each other, and which consists of a connecting cylinder provided at the lower portion thereof, having a female screw in the inner surface of a central bore therein and fitted closely in said upper barrel member, a guide cylinder fitted pivotably around the upper portion of said connecting cylinder and engaged tightly with the inner surface of said lower barrel member to thereby set said upper and lower barrel members pivotable with respect to each other, and a movable cylinder which has in and on its outer circumferential surface slits and a male screw engaged with said female screw in said connecting cylinder, and which is thereby set axially movable owing to the screw pair in said movable cylinder and said connecting cylinder; locking memebers consisting of slits in a port of the outer circumferential surface of said movable cylinder and guide projections on a pair of the inner circumferential surface of said guide cylinder which is fitted around said movable cylinder, which slits and projections are engaged with each other unitarily to guide the displacement of said movable cylinder straight in the axial direction thereof; and a lead-extruding structure which is held in said barrel, and which consists of an extrusion unit capable of extruding the lead in a stepped manner by a very small length at a time by the operations of a chuck provided at a lower portion of a push-down tube and a tightening ring fitted around said chuck, a push-button member projecting from the rear end of said barrel, a protective pipe provided at the lower end of said lead-extruding structure so as to extend toward an end bore in a metal tip, and an outer tube provided on the outer side of said push-down tube and fixed to said movable cylinder so that said lead-extruding structure can be operated in accordance with the movement of said movable cylinder, said protective pipe in said lead-extruding structure being projected by an arbitrary length from the free end of said metal tip by turning either of said two barrel members.

DESCRIPTION OF THE PREFERRED EMBODIMENT

Figure 1:
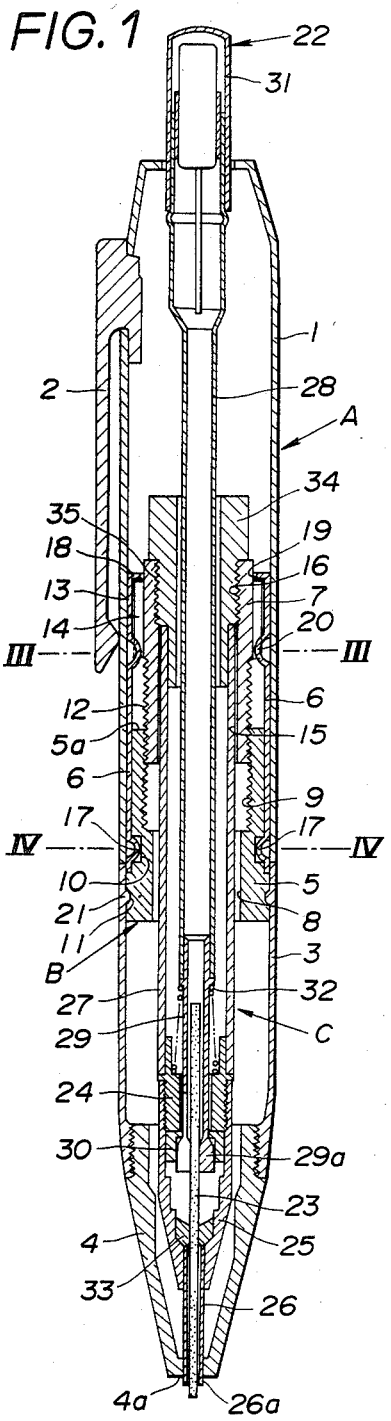
FIG. 1 is a longitudinal section taken along the plane including the axis of a mechanical pencil, in which a lead-extruding structure is in the rearmost position with the whole of a lead-protecting pipe retracted in the interior of a metal tip.

An embodiment of the present invention will now be described in detail with reference to the drawings.

Reference letter A denotes a barrel which is provided with an upper barrel member 1 having a clip 2 fixed to the upper portion thereof, and a lower barrel member 3 having a metal tip 4 joined to the lower portion thereof, which upper and lower barrel members 1, 3 are formed separately and abutted at their lower and upper ends on each other to obtain a single shaft of a predetermined length.

Reference letter B denotes a unit structure, to the outer surface of which the upper and lower barrel members 1, 3 of the barrel A are joined to each other to form a single barrel A. To the inner side of this unit structure B, a lead-extruding structure is connected so that the structure C can be moved forward and backward.

This unit structure B consists of a connecting cylinder 5, a guide cylinder 6 and a movable cylinder 7. The connecting cylinder 5 is provided with a female screw 9 in the upper portion of its central bore 8, an annular groove 10 of a predetermined width in the intermediate portion of its outer circumferential surface, and a locking recess 11 in the lower portion of the same outer circumferential surface. The movable cylinder 7 is provided with a male screw 12 on the lower portion of its outer circumferential surface, an annular sleeve 13 on the upper portion of the same outer circumferential surface, slits 14 in the diametrically opposite portions of the outer circumferential surface of this sleeve 13 so as to extend over the whole length thereof, and a female screw 16 in the upper portion of the central bore 15 in the movable cylinder 7. The male screw 12 on the movable cylinder 7 is engaged with the female screw 9 in the connecting cylinder 5, and, when the connecting cylinder 5 is turned, the movable cylinder 7 is moved forward or backward in the axial direction thereof within the range of distance corresponding to the axial length of the engaged portions of these cylinders 5, 7. The guide cylinder 6 is fitted at its lower portion loosely around the outer surface of the connecting cylinder 5 so that the guide cylinder 6 can be turned with respect to the connecting cylinder 5. An inwardly-extending projection 17 made by inwardly bending a portion of the guide cylinder 6 is fitted in the annular groove 10 in the connecting cylinder 5 to prevent the guide cylinder 6 from dropping. A top wall 18 at the upper portion of the guide cylinder 6 is provided in a position which is substantially as high as the upper surface of the movable cylinder 7 in a retreated position so that, when the movable cylinder 7 is moved to the upper limit position, the upper end of the annular sleeve 13 impinges upon the top wall 18. The top wall 18 is provided with a central bore 19, through which a part of the upper end of the retreated movable cylinder 7, and an extrusion tube in the lead-extruding structure C are inserted. The guide projections 20 are provided on the inner surface of the upper portion of the circumferential wall of the guide cylinder 6. These projections 20 are fitted in the slits 14 in the movable cylinder 7 to guide the same cylinder 7 linearly. When the guide cylinder 6 is fixed with the connecting cylinder 5 turned with respect thereto, the cylinder 7 is moved forward or backward owing to the screw pair of the female 9 in the connecting cylinder 5 and the male screw 12 on the movable cylinder 7, and the turning of the cylinder 7 is stopped by the guide projections 20 fitted in the slits 14, the cylinder 7 being then moved linearly along the guide projections 20 on the guide cylinder 6. The cylinder 7 may be moved so as to turn the guide cylinder 6 with the connecting cylinder fixed instead of turned. In this case, the guide cylinder 6 is turned on the outer side of the connecting cylinder 5, so that the cylinder 7, which is moved owing to the screw pair, is guided linearly as it is turned by the guide projections 20.

In the unit structure B constructed as described above, the guide cylinder 6 is inserted under pressure into the lower portion of the interior of the upper barrel member 1, and the lower end portion of the connecting cylinder 5, which projects from the lower end of the guide cylinder 6, into the upper portion of the interior of the lower barrel member 3, and then fixed, respectively. Reference numeral 21 denotes a locking portions of the lower barrel member 3 and connecting cylinder 5. When either of the upper and lower barrel members 1, 3 of the barrel A is turned, the cylinder 7 is moved forward or backward as it is guided by the guide projections 20, as mentioned previously. When the cylinder 7 is in the forward limit position, the lower end of the annular sleeve 13 engages an upper end **5*a* of the connecting cylinder 5, and, when the cylinder 7 is in the backward limit position, the upper end of the annular sleeve 13 engages the top wall 18, to limit the movement of the cylinder 7. The lead-extruding structure C is formed so that a lead 23 can be projected to a very small extent every time a push-button member 22 is pressed. As generally known, the parts of the structure C include a fixed cylinder 24, a metal tip 25 joined to the lower portion of the fixed cylinder 24, a protective pipe 26 fitted under pressure and fixed in the central bore in the lower portion of the metal tip 25, an outer tube 27 joined to the rear portion of the fixed cylinder 24, a push-down tube 28, and a chuck tube 29 which has a tightening ring 30 fitted around a chuck 29*a* provided at the lower end thereof, and which is joined at its upper end to the push-down tube 28. The rear end portion of the push-down tube 28 projects a predetermined distance from the rear end of the upper barrel member 1, and a cap 31 is put over this projecting portion of the push-down tube to form the push-button member 22. When the push-down tube 28 is pressed against a coiled spring 32, the chuck 29*a* sends out the lead 23 by the length corresponding to the distance between a normal position of the chuck 29*a* and a position in which the chuck 29*a* is released from the tightening ring 30. Reference numeral 33 denotes a lead retainer of a rubber material, which is adapted to elastically retain the lead 23**.

Figure 2:
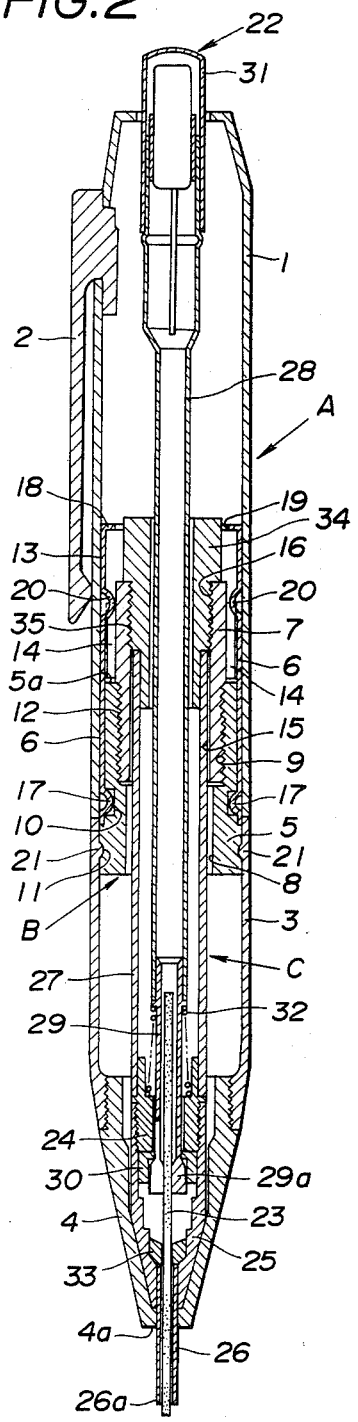
FIG. 2 show the lead-extruding structure in the foremost position with the lead-protecting pipe projecting to a maximal extent from the free end of the metal tip.
Figure 3:
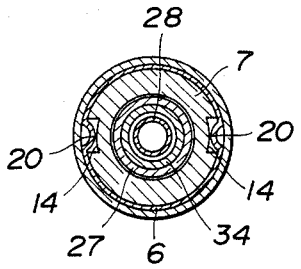
FIGS. 3 and 4 are horizontal sections of the connecting cylinder, which are taken along the lines III—III and IV—IV, respectively, in FIG. 1.
Figure 4:
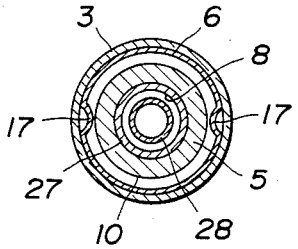

The lead-extruding structure C thus constructed is set movable in the axial direction thereof in accordance with the movement of the cylinder 7 by fitting under pressure the lower end portion of a fixed cylinder 34, which is fitted around the push-down tube 28, into the rear end of the outer tube 27 to be fixed therein and thereby set the fixed tube in the barrel A, and engaging a male screw 35, which is provided on the outer circumferential surface of an intermediate portion of the fixed tube 34, with the female screw, which is formed in the movable cylinder 7, to be firmly combined therewith. The installing of this lead-extruding structure C is done in such a preset manner that, when the cylinder 7 is in the rear limit position in the barrel A as shown in FIG. 1, the free end 26*a* of the protective pipe 26 is flush with the front end surface of the metal tip 4 or retracted in the metal tip 4, and in such a manner that, when the cylinder 7 is moved forward free end 26*a* is moved to the front limit position as referred to previously, by turning the lower barrel member 3 as shown in FIG. 2, the lead-extruding structure C is also moved forward a distance corresponding to the quantity of movement of the cylinder 7, to cause the protective pipe 26 to project a maximal permissible distance from the front end 4*a* of the metal tip 4. Even when the lead-extruding structure C is in the lowermost position, it enables a push-button-pressing operation in which the push-button member 22 is projected by a predetermined distance from the rear end of the upper barrel member 1 to send out the lead 23.

As is clear from the above statement, the mechanical pencil according to the present invention is capable of determining the projection length of the protective pipe arbitrarily in accordance with the pivotal movement of either of the two barrel members, which projection length varies from the level in the case where the protective pipe is retracted in the metal tip as shown in FIG. 1 to the level in the case where the protective pipe is extended to a maximal extent as shown in FIG. 2. The barrel A is provided in some cases with a rotary memory on its outer circumferential surface, which memory displays the actual projection length of the protective pipe 26. If such a rotary memory is provided, a projection length to be determined can be set easily, and the projection length during the use of the mechanical pencil can be read instantly.

Owing to the above-described construction, when either of the barrel members of the barrel is turned, the movable cylinder is displaced upward or downward due to the screw pair in the unit structure, so that the lead-extruding structure, which is combined unitarily with the movable cylinder, is moved up or down to cause the protective pipe to be projected from or retracted into the metal tip to such an extent at a time that corresponds to the pitch of the screws. Therefore, a required projection length can be finely regulated. Accordingly, the mechanical pencil can be used with the protective pipe projected in an optimum level between the level in the case where the protective pipe projects to a maximum extent and the level in the case where the protective pipe projects to only a small extent, in accordance with the use thereof and the taste of the user. Since the lead-extruding structure can be extended and retracted apart from the lead-extending push-button-pressing operation, the mechanical pencil can be handled easily and conveniently, and the construction of the lead-extruding structure can be simplified. While the mechanical pencil is not in use, the projecting protective pipe retracts completely into the metal pipe, so that the mechanical pencil can be carried safely. Moreover, since the protective pipe is fixed to the front end of the lead-extruding structure, it does not retreat as the lead is worn. This enables the mechanical pencil to be used for writing letters safely and conveniently.

What is claimed is:

1. A push button type mechanical pencil comprising a barrel consisting of upper and lower barrel members which are engaged with each other at a substantially vertically-intermediate portion of said barrel; a unit structure of a rotatable construction which combines said upper and lower barrel members with each other, and which consists of a connecting cylinder provided at the lower portion thereof, having a female screw in the inner surface of a central bore therein and fitted closely in said upper barrel member, a guide cylinder rotatably attached around the upper portion of said connecting cylinder and engaged tightly with the inner surface of said lower barrel member to thereby set said upper and lower barrel members relatively rotatable with respect to each other, and a movable cylinder which has in and on its outer circumferential surface slits and a male screw engaged with said female screw in said connecting cylinder, and which is thereby set axially movable owing at least in part to the screw pair in said movable cylinder and said connecting cylinder; guide members consisting of said slits in the outer circumferential surface of said movable cylinder and guide projections on a part of the inner circumferential surface of said guide cylinder which is fitted around said movable cylinder, which slits and projections are engaged with each other unitarily to guide the displacement of said movable cylinder straight in the axial direciton thereof; and a lead-extruding structure which is held in said barrel, and which consists of an extrusion unit capable of extruding the lead in a stepped manner by a very small length at a time by the operations of a chuch provided at a lower portion of a push-down tube and a tightening ring fitted around said chuck, a push-button member projecting from the rear end of said barrel, a protective pipe provided at the lower end of said lead-extruding structure so as to extend toward an end bore in a metal tip, and an outer tube provided on the outer side of said push-down tube and fixed to said movable cylinder so that said lead-extruding structure can be operated in accordance with the movement of said movable cylinder, said protective pipe in said lead-extruding structure being projected by an arbitrary length from the free end of metal tip by turning either of said two barrel members.

* * * * *